US010239722B2

(12) United States Patent
Baba et al.

(10) Patent No.: US 10,239,722 B2
(45) Date of Patent: Mar. 26, 2019

(54) PUNCHING SYSTEM

(71) Applicant: SEIKO LTD., Kawasaki-shi, Kanagawa (JP)

(72) Inventors: Kenji Baba, Kawasaki (JP); Chiaki Osada, Kawasaki (JP); Koutaro Yamanaka, Kawasaki (JP)

(73) Assignee: SEIKO LTD., Kawasaki-Shi, Kanagawa (JP)

( * ) Notice: Subject to any disclaimer, the term of this patent is extended or adjusted under 35 U.S.C. 154(b) by 72 days.

(21) Appl. No.: 15/292,806

(22) Filed: Oct. 13, 2016

(65) Prior Publication Data

US 2017/0107073 A1 Apr. 20, 2017

(30) Foreign Application Priority Data

Oct. 15, 2015 (JP) ..... 2015-203321

(51) Int. Cl.
*B65H 5/06* (2006.01)
*B65H 35/00* (2006.01)
*G03G 15/00* (2006.01)

(52) U.S. Cl.
CPC ..... *B65H 35/0086* (2013.01); *B65H 5/062* (2013.01); *G03G 15/6582* (2013.01); *B65H 2301/5152* (2013.01); *G03G 2215/00818* (2013.01)

(58) Field of Classification Search
CPC .. G03G 2215/00818; B65H 2301/5152; B65H 35/0086; B65H 2301/5153; Y10T 83/4612
See application file for complete search history.

(56) References Cited

U.S. PATENT DOCUMENTS 5,839,336 A * 11/1998 Yamauchi ..... B26D 1/06 355/408
5,911,414 A * 6/1999 Kato ..... B26F 1/10 234/38
2007/0227324 A1* 10/2007 Baba ..... B26D 5/16 83/37
2013/0114984 A1* 5/2013 Nonaka ..... B26F 1/14 399/381

FOREIGN PATENT DOCUMENTS

JP 2000-334696 A 12/2000
JP 2002-239986 A 8/2002
(Continued)

*Primary Examiner* — Jennifer E Simmons
(74) *Attorney, Agent, or Firm* — Manabu Kanesaka

(57) ABSTRACT

The invention provides a punching system that has a relatively simple structure to provide an apparatus reduced in overall size and having a low profile, and can produce a high-quality punched hole while conveying a sheet. The punching system includes a punching device that has a punching member moving back and forth perpendicularly to the sheet being conveyed, a frame, and a sheet conveyance mechanism. The punching device is attached to the frame by an attachment unit in such a manner that it is movable in the sheet conveyance direction. The sheet conveyance mechanism includes carry-out rollers that sandwich the downstream end of the sheet at the start of sheet punching motion of the punching member and that are installed at positions downstream from and transversely corresponding to the punching position.

17 Claims, 16 Drawing Sheets

(56) References Cited

FOREIGN PATENT DOCUMENTS

| | | | | |
|---|---|---|---|---|
| JP | 2003-276925 | A | | 10/2003 |
| JP | 2008-173734 | A | | 7/2008 |
| JP | 2013-043224 | A | | 3/2013 |
| JP | 2013043224 | A | * | 3/2013 |
| JP | 2013-121651 | A | | 6/2013 |

* cited by examiner

PUNCHING SYSTEM

RELATED APPLICATIONS

The present application is based on, and claims priority from, Japanese Application No. JP2015-203321 filed Oct. 15, 2015, the disclosure of which is hereby incorporated by reference herein in its entirety.

TECHNICAL FIELD

The present invention relates to a punching system designed to automatically produce punched holes for filing or other purposes in sheet-like materials or other processed articles, such as paper sheets, plastic sheets, metal sheets, and fabric sheets.

BACKGROUND ART

Conventionally, image forming apparatuses including copiers, printers, and facsimiles, and others including post-processing apparatuses and bookbinding machines are equipped with punching devices to produce, for example, filing holes in sheets, such as paper sheets, delivered from them. In recent years, high-speed processing techniques have been developed for processing sheets delivered from image forming apparatuses and, in order to meet the latest developments, there are increasing demands for punching devices with high punching speed and high efficiency.

In most punching devices, a punching member, driven by a drive motor via a cam mechanism, is moved back and forth in the punching direction so that a sheet is punched after it is conveyed to a predetermined position. In this case, if a sheet is punched without a halt while it is conveyed, the punching member, after punching a hole, can come into strong contact with the edge of the punched hole as it is come out of the punched hole, leading to damage to the punched hole, deterioration in its quality, or paper jam.

Japanese Unexamined Patent Publication (Kokai) No. 2008-173734 describes a punching device in which a punching unit and a die unit are conveyed together with the sheet at the same speed while punching is performed. The punching unit and the die unit in this punching device are moved back and forth in the sheet conveyance direction by a crank mechanism that can move in the width direction of the sheet.

Japanese Unexamined Patent Publication (Kokai) No. 2013-43224 proposes a punching device that has a simpler structure and control mechanism to perform punching while conveying a punching unit and a die unit together with the sheet at the same speed, as in the above device. In this punching device, a punching unit having a punching member and a die is moved back and forth in the sheet conveyance direction by a cylindrical cam mounted on a horizontal rotary shaft while the punching member punches a hole in a sheet as it is moved back and forth by a bulging cam mounted coaxially on the shaft that supports the cylindrical cam.

SUMMARY OF THE INVENTION

Problems to be Solved by the Invention

In recent years, there are increased demands for compact image forming apparatuses and accordingly, for more compact punching devices, especially lower profile devices, to be mounted on them. The punching device described in the above Japanese Unexamined Patent Publication (Kokai) No. 2008-173734 requires not only the crank mechanism that moves the punching unit and the die unit in the sheet conveyance direction, but also a separate moving mechanism for moving them in the width direction of the sheet. Accordingly, there may occur problems such as requiring an apparatus with a larger overall size, more complicated structure, or more complicated control.

The punching device described in the above Japanese Unexamined Patent Publication (Kokai) No. 2013-43224 has the cylindrical cam and the bulging cam that rotate together on the shaft to realize the back-and-forth motion of the punching member and the die in the sheet conveyance direction and the punching motion of the punching member. It is difficult to perform punching motion by means of that cylindrical cam, while adjusting the moving speed of the punching member and the die accurately to the sheet conveyance speed.

Thus, an object of the present invention, which was made in view of these problems with the conventional technology, is to provide a punching system that has a relatively simple structure to perform high-quality punching while conveying a sheet and also enables to provide an apparatus reduced in overall size and having a low profile.

Means of Solving the Problems

In order to achieve the above object, the present invention provides a punching system comprising:

a punching device having a punching member with a punching blade at one axial end thereof and adapted to move the punching member axially reciprocally to produce a punched hole in a sheet conveyed in a predetermined conveyance direction, and a support portion supporting the punching device to allow the punching device to move together with the sheet in the predetermined conveyance direction by engagement of a circumferential face of the punching member with a periphery of the punched hole.

With this unique structure, the system can punch a hole in a sheet being conveyed, without using a complicated structure or driving means, while moving the punching device together with the sheet in a predetermined conveyance direction, as it is pushed by the periphery of the punched hole that is engaged with the circumferential face of the punching member. Thus, the moving speed of the punching device is equal to the sheet conveyance speed, enabling to produce a high-quality punched hole.

In an embodiment, the punching system further includes a spring biasing the punching device in the opposite direction to the predetermined conveyance direction. By a biasing force of the spring, the punching device can be, immediately after the punching member is released from the punched hole, forcibly and automatically returned to the original punching start position to quickly prepare for the next punching motion.

In another embodiment, a punching blade is formed on the periphery of the cylindrical part at the one axial end of the punching member, in which the periphery of the cylindrical part has two V-shaped notches located at opposed positions when seen from a lateral direction, and a straight line connecting bottoms of the V-shaped notched grooves forms an angle in the range of 90°±45° with the predetermined conveyance direction when the punching member is released from the punched hole in the sheet as it moves in the axial direction. This may ensure that the possibility of damages to the periphery of the punched hole and its deterioration in quality that can be caused by an edge of the punching blade coming in contact with the periphery of the punched hole as it withdraws from the hole is eliminated or decreased.

In another embodiment, the punching system further includes a sheet conveyance portion at a position downstream in the predetermined conveyance direction from a punching position where the sheet is punched by the punching member and corresponding to the punching position in a direction perpendicular to the predetermined conveyance direction, to feed the sheet forward in the predetermined conveyance direction at a start of punching of the sheet. The sheet conveyance portion may produce a sheet conveying force that overcomes a resistance caused by the engagement between the circumferential face of the punching member and the periphery of the punched hole to hinder smooth conveyance of the sheet, so that skewing of the sheet and associated paper jam will be avoided to ensure formation of a high quality punched hole.

In another embodiment, the sheet conveyance component has a pair of rollers located above and below the sheet to sandwich it therebetween. The pair of rollers may produce an adequate sheet conveying force to overcome the resistance caused by the engagement between the circumferential face of the punching member and the periphery of the punched hole.

In still another embodiment, the system further includes an overload protection mechanism that reduces a load acting in the predetermined conveyance direction between the circumferential face of the punching member and the periphery of the punched hole that are engaged with each other, as the punching device and the sheet move in the predetermined conveyance direction. It may be enhanced by the overload protection mechanism to prevent damage to the punched hole and deterioration in its quality, even if a sudden excessive load occurs between the circumferential face of the punching member and the periphery of the punched hole, for example as result of an increased sheet conveyance speed.

In an example, an overload protection mechanism is provided to the pair of rollers.

In another aspect, the present invention provides a sheet processing apparatus that is equipped with the punching system according to the present invention described above to enable formation of a high-quality punched hole. Here, the sheet processing apparatus as stated above includes a post-processing apparatus connected to an image forming apparatus, a bookmaking apparatus, and any other type of sheet processing apparatus that performs punching of a sheet.

In still another aspect, the present invention provides an image forming apparatus that is equipped with the punching system according to the present invention or with a sheet processing apparatus that includes the punching system according to the present invention to perform the formation of a high quality punched hole in an image-formed sheet.

DESCRIPTION OF PREFERRED EMBODIMENTS

The punching system according to the present invention will be described in detail below based on exemplary embodiments and with reference to the attached drawings. The punching system according to the embodiment is incorporated in a main apparatus that contains, for example, units for image formation or subsequent post-processing, and used to, for example, punch filing holes while conveying a sheet, such as paper sheet, fed from the image formation unit.

Figure 1:
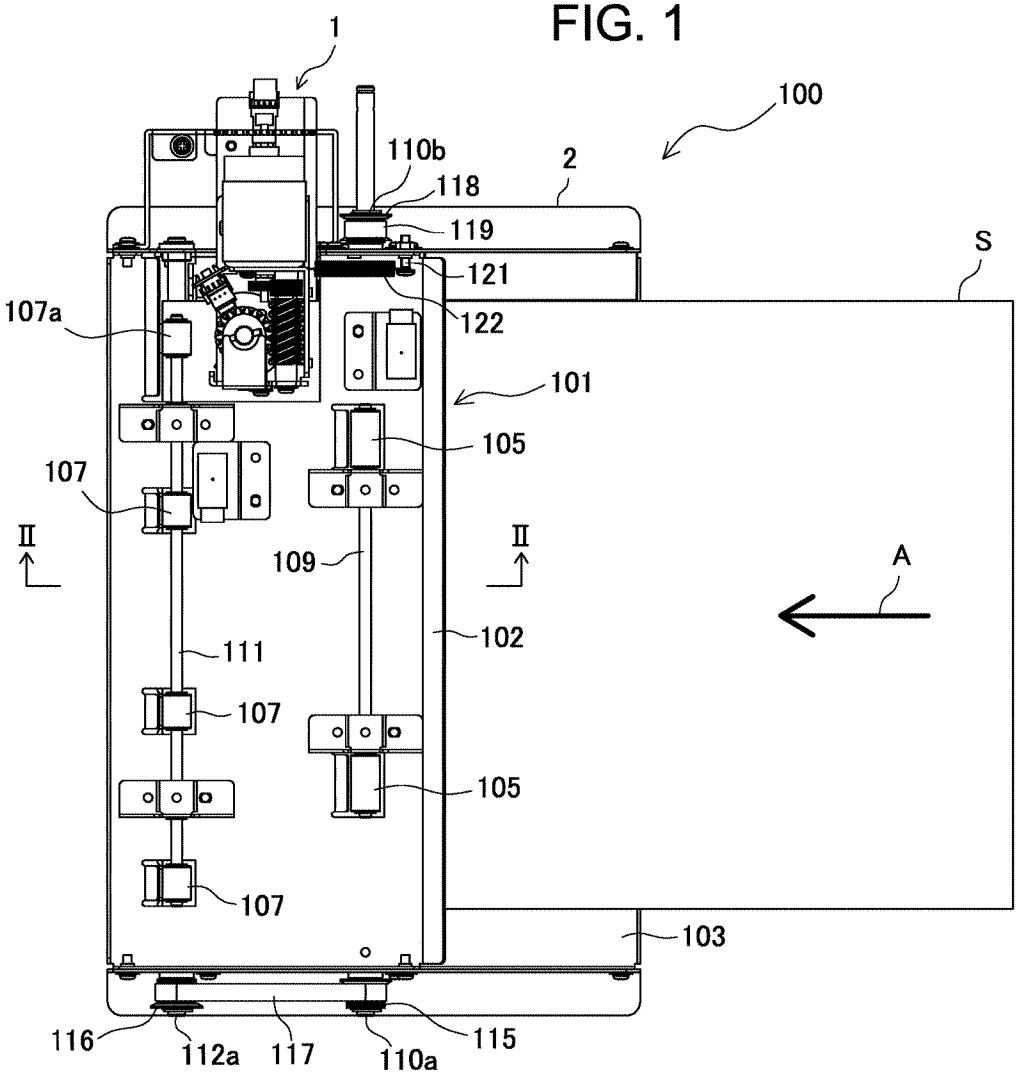
FIG. 1 is a plan view illustrating an embodiment of the punching system according to the present invention.
Figure 2:
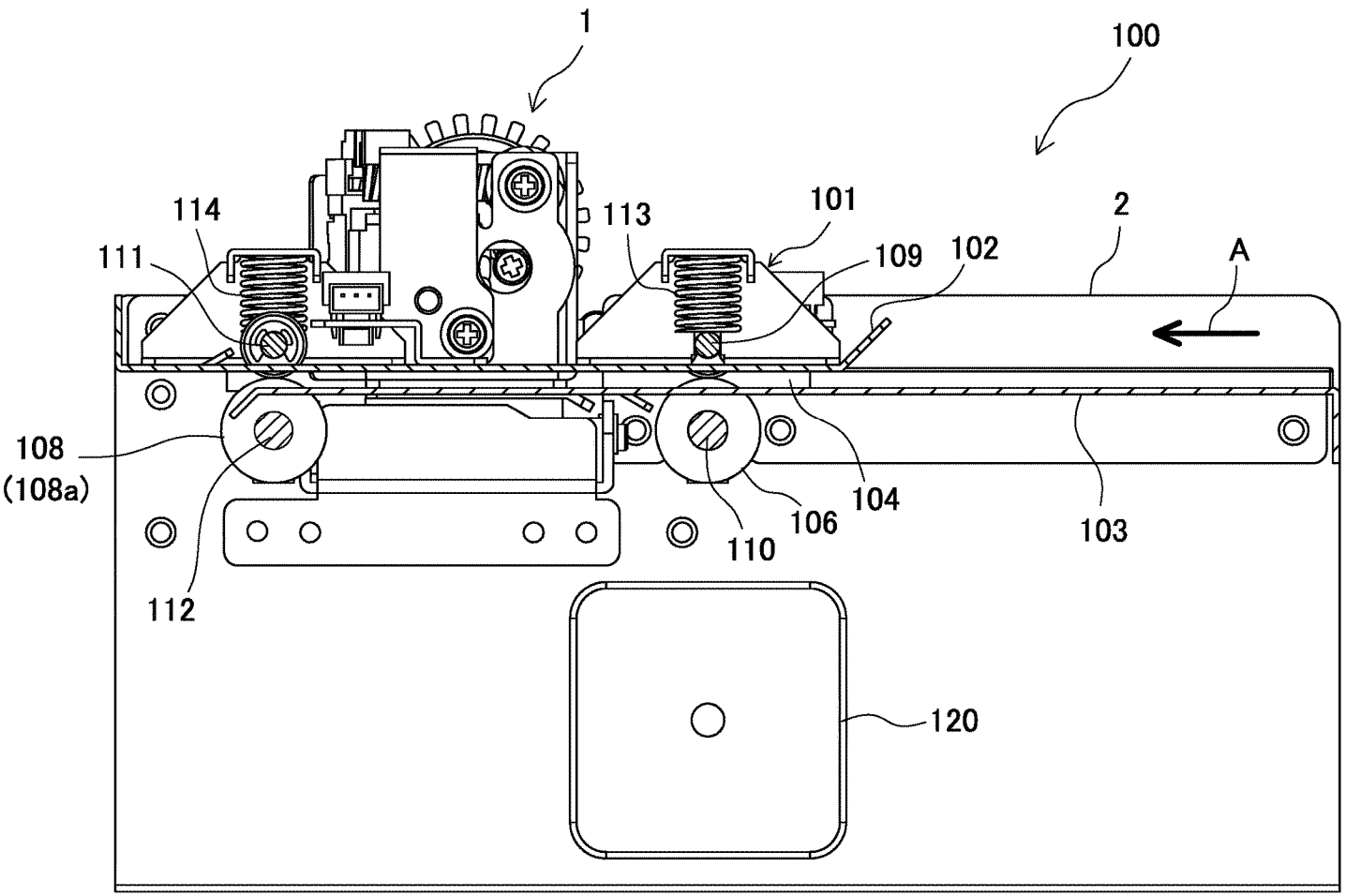
FIG. 2 is a side view of the punching system illustrated in FIG. 1.

FIGS. 1 and 2 show an overall structure of a punching system 100 that represents a preferred embodiment of the present invention. The punching system 100 includes a punching device 1, a frame 2 to support the punching device, and a sheet conveyance mechanism 101 to convey a sheet S. The sheet conveyance mechanism 101 extends in the sheet conveyance direction A from the upstream side to the downstream side of the punching device 1 and has an upper guide plate 102 and a lower guide plate 103 that are opposed to each other. A guide path 104 for the sheet S is defined as a constant narrow gap between the upper guide plate and the lower guide plate.

The upper and lower guide plates 102 and 103 have two pairs of rollers located immediately upstream in the sheet conveyance direction A from the punching device 1, each pair consisting of upper and lower carry-in rollers 105 and 106, and the pairs being located at laterally symmetric positions with respect to the sheet conveyance direction A. Four pairs of rollers are also present immediately downstream in the sheet conveyance direction A from the punching device 1, each pair consisting of upper and lower carry-out rollers 107 (107*a*) and 108 (108*a*), and two and the other two of the pairs being located at laterally symmetric positions with respect to the sheet conveyance direction A. The pair of carry-out rollers 107*a* and 108*a* that are nearest to the punching device 1, in particular, are located at a position that is on the downstream side of the punching position of the punching device 1 and corresponds, in the lateral direction, to the punching position.

The carry-in rollers of each pair are supported to be rotationally driven by carry-in roller shafts 109 and 110 extending in the lateral direction across the upper or lower guide plates 102 and 103. The carry-out rollers of each pair are supported similarly to be rotationally driven by carry-out roller shafts 111 and 112 extending in the lateral direction across the upper or lower guide plates 102 or 103.

A predetermined pressure is applied onto the upper carry-in roller shaft 109 and the upper carry-out roller shaft 111 toward the lower carry-in roller shaft 110 and the lower carry-out roller shaft 112 by coil springs 113 and 114, respectively. This allows the circumferential faces, i.e., the roller surfaces, of the upper carry-in roller 105 and the upper carry-out roller 107 are pressed against the circumferential faces, i.e., the roller surfaces, of the lower carry-in roller 106 and the lower carry-out roller 108, respectively, with a predetermined pressure. With this pressing force, the carry-in and carry-out rollers come in pressed contact with the surfaces of the sheet S in the guide path 104 through openings provided in the upper and lower guide plates 102 and 103 so that they sandwich the sheet from above and below and convey the sheet in the conveyance direction A as the carry-in roller shaft and the carry-out roller shaft rotate.

The lower carry-in roller shaft 110 and the lower carry-out roller shaft 112, which are located on the opposite sides of the punching device 1, are linked to each other at their ends 110*a* and 112*a* by a belt 117 running on pulleys 115 and 116 of a belt drive mechanism. The other end 110*b* of the carry-in roller shaft 110 is linked in a similar manner to the output shaft (not shown in the drawings) of a drive motor 120 by a belt 119 running on a pulley 118 of another belt drive mechanism Accordingly, as the drive motor rotates, the lower carry-in roller shaft 110 and the lower carry-out roller shaft 112 are driven to rotate in the sheet conveyance direction so that the upper carry-in roller 105 and the upper carry-out roller 107, which are pressed against the lower carry-in roller 106 and the lower carry-out roller 108, rotate similarly in the sheet conveyance direction.

Figure 3:
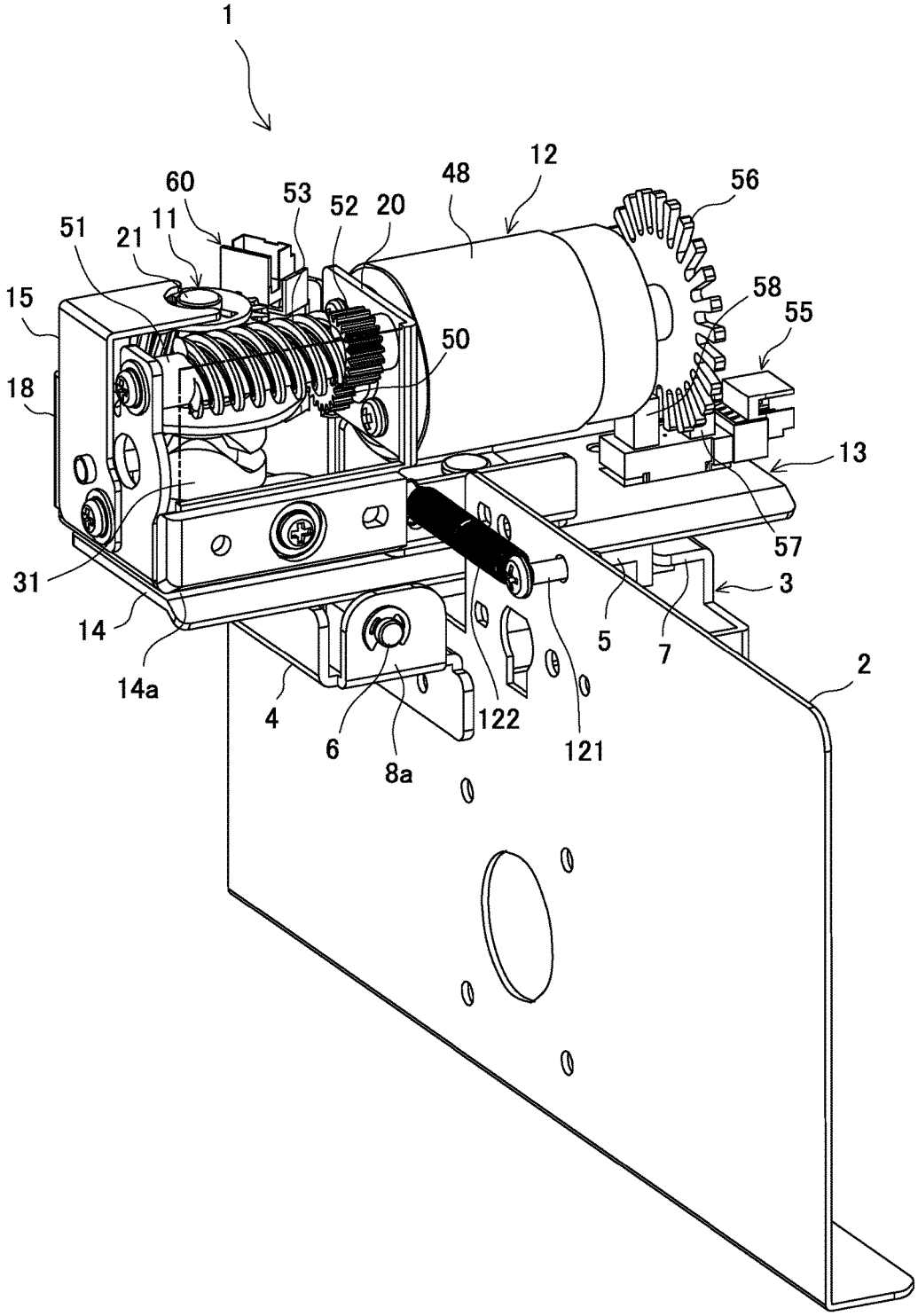
FIG. 3 is a perspective view of a punching device in the punching system illustrated in FIG. 1.
Figure 4:
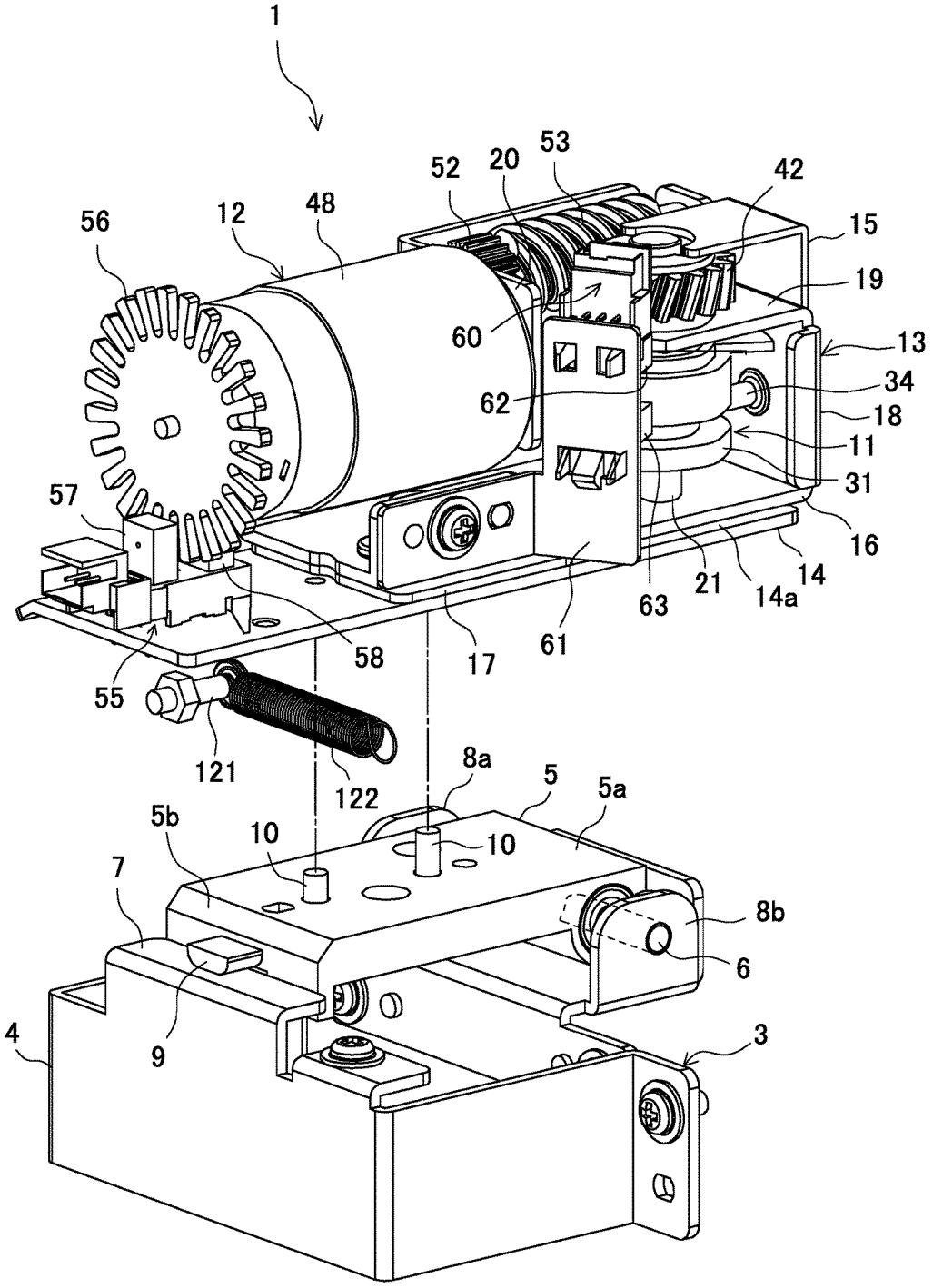
FIG. 4 is a perspective view of the punching device illustrated in FIG. 3 seen from the opposite side.

FIGS. 3 and 4 show the overall structure of the punching device 1. The punching device 1 is fixed to a frame 2 with an attachment unit 3 as shown in FIG. 4. The attachment unit 3 has a lower support member 4 fixed to the frame 2, and an upper movable attachment member 5 that can move on the support member. In the upper part of the support member 4, a horizontal guide rod 6 is provided along one side and a horizontal guide rail 7 extending parallel to the guide rod is provided along the opposite side. Stoppers 8*a* and 8*b* are provided at each end in the axial direction of the guide rod 6.

The guide rod 6 penetrates a side part 5*b* of the movable attachment member 5 in such a manner that it can slide in its axial direction. In the opposite side part of the movable attachment member 5, a sliding piece 9 protrudes in the horizontally outer direction in such a manner that it can slide along the guide rail 7 on the flat top face of the guide rail 7. This allows the movable attachment member 5 to move linearly in the sheet conveyance direction between the stoppers 8*a* and 8*b* along the guide rod 6 and the guide rail 7. The end edge of the side part 5*b* of the movable attachment member 5 is bent to the horizontally outer direction and extends immediately below the guide rail 7 to prevent the movable attachment member 5 from coming off upward.

The punching device 1 has a punching unit 11, a drive unit 12, and a frame structure 13. To guide the sheet to be punched, the frame structure 13 has a lower frame 14 for attaching the punching device 1 to the attachment unit 3, and an upper frame 15 to which the punching unit 11 and the drive unit 12 are attached.

In this embodiment, the punching device 1 is fixed to the top face of the movable attachment member 5 and thereby to the attachment unit 3 by inserting the attaching screw 10, which penetrates the top face from below, into an attachment hole (not shown) provided in the lower frame 14. In this instance, the lower frame 14 has a plurality of protrusions on its lower face, which are fitted into the corresponding positioning holes provided on the top face of the movable attachment member 5 to ensure high position accuracy in attaching the punching device 1 to the attachment unit.

The frame 2 has a protruded pin 121 located immediately upstream in the sheet conveyance direction from the punching device 1. Between the punching device 1 and the frame 2, there exists a tension coil spring 122 with its ends hooked on the upper frame 15 and a pin 121. The tension coil spring 122 normally biases the punching device 1 to its home position where the upstream end of the movable attachment member 5 is stopped in contact with the upstream stopper 8*a*.

Figure 5:
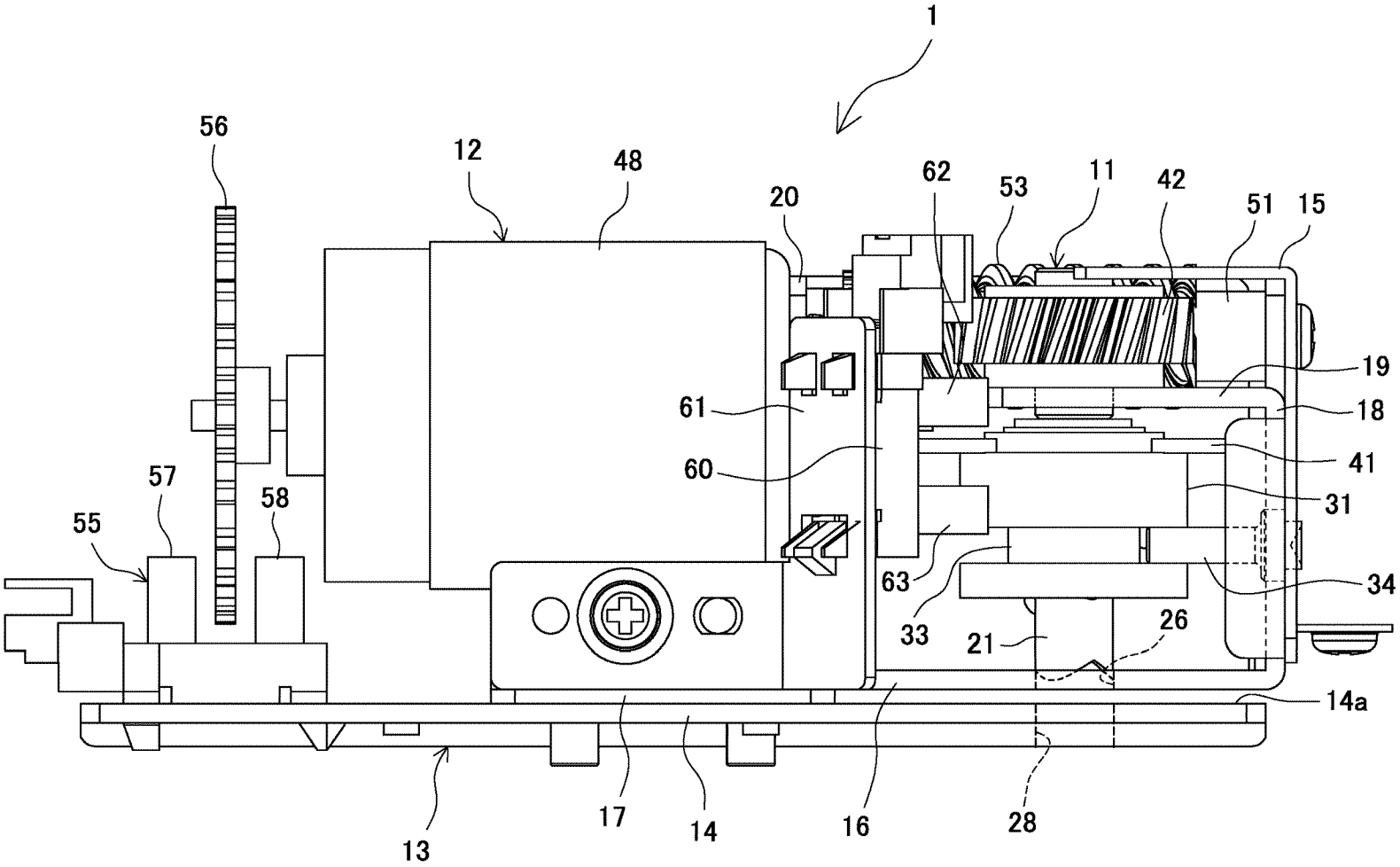
FIG. 5 is a front view of the punching device.
Figure 6:
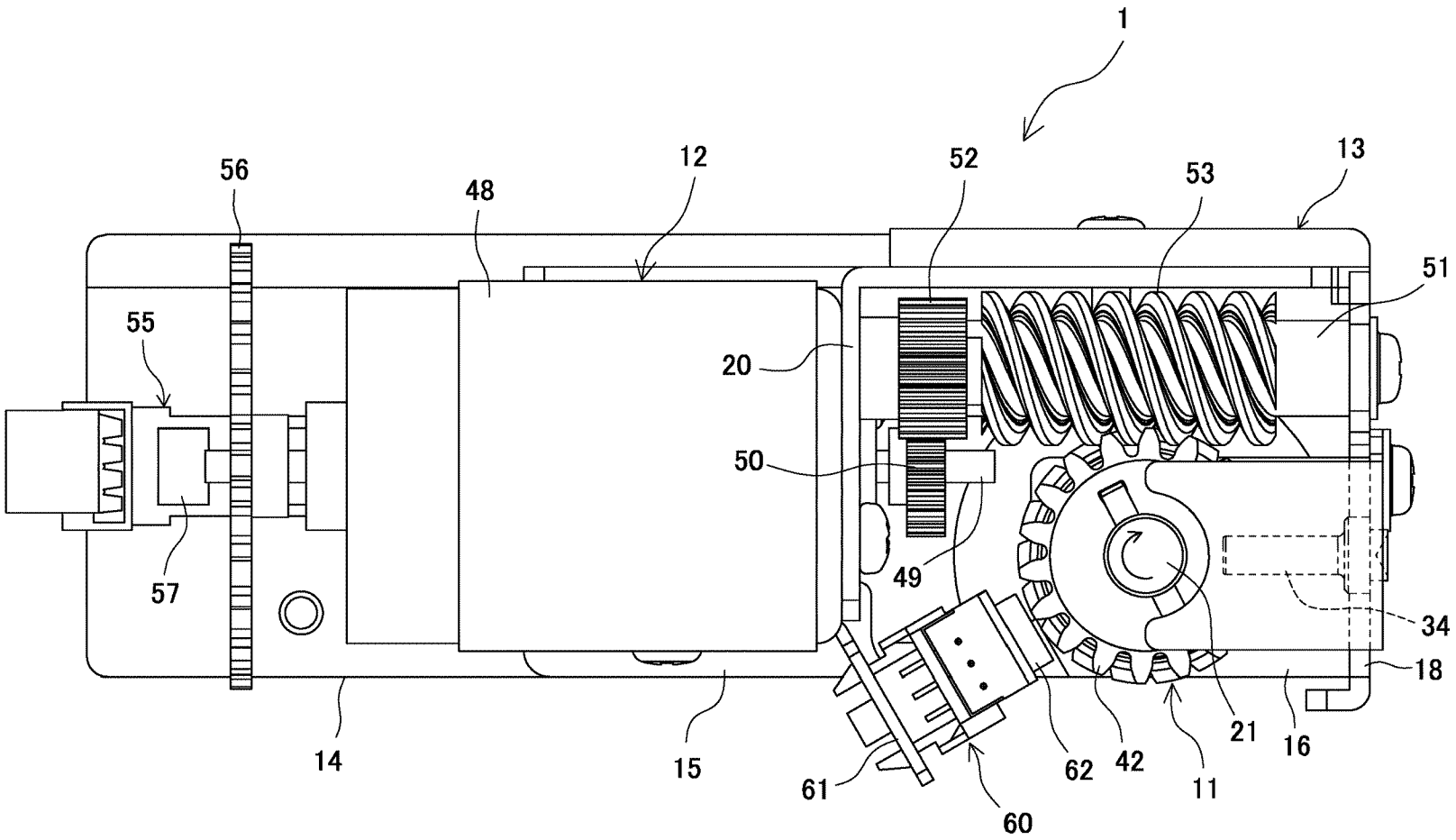
FIG. 6 is a top view of the punching device.

As shown in FIGS. 5 and 6, the lower frame 14 is composed mainly of a roughly rectangular plate-like member, and the lower plate 16 of the upper frame 15 is connected in an integrated manner to an end part of the top face of the lower frame, with a spacer plate 17 sandwiched therebetween. The opposite-end part of the top face of the lower frame 14 provides a horizontal, flat sheet support face 14*a* supporting the sheet S, which is the object to be punched, and is disposed in such a manner as to be opposed to the lower plate 16 with a constant narrow gap formed therebetween.

The sheet support face 14*a* is substantially flush with the top face of the lower guide plate 103 of the sheet conveyance mechanism 101. The gap between the sheet support face 14*a* and the lower plate 16 is substantially as narrow as the guide path 104 in the sheet conveyance mechanism 101. This allows the sheet conveyed through the guide path 104 to travel smoothly on the sheet support face 14*a* in the punching device 1.

As shown in FIGS. 5 and 6, in the upper frame 15, the punching unit 11 is disposed on the sheet support face 14*a* side and the drive unit 12 is disposed on the spacer plate 17 side. The upper frame 15 further includes a side plate 18 that is bent perpendicularly upward at the far end of the lower plate 16 from the drive unit 12, an upper plate 19 that is bent horizontally inward, i.e., parallel to the lower plate 16, at the end of the side plate to form a horizontal U shape as a whole, and a side plate 20 disposed opposite to the side plate 18 with the punching unit 11 therebetween.

Figure 7:
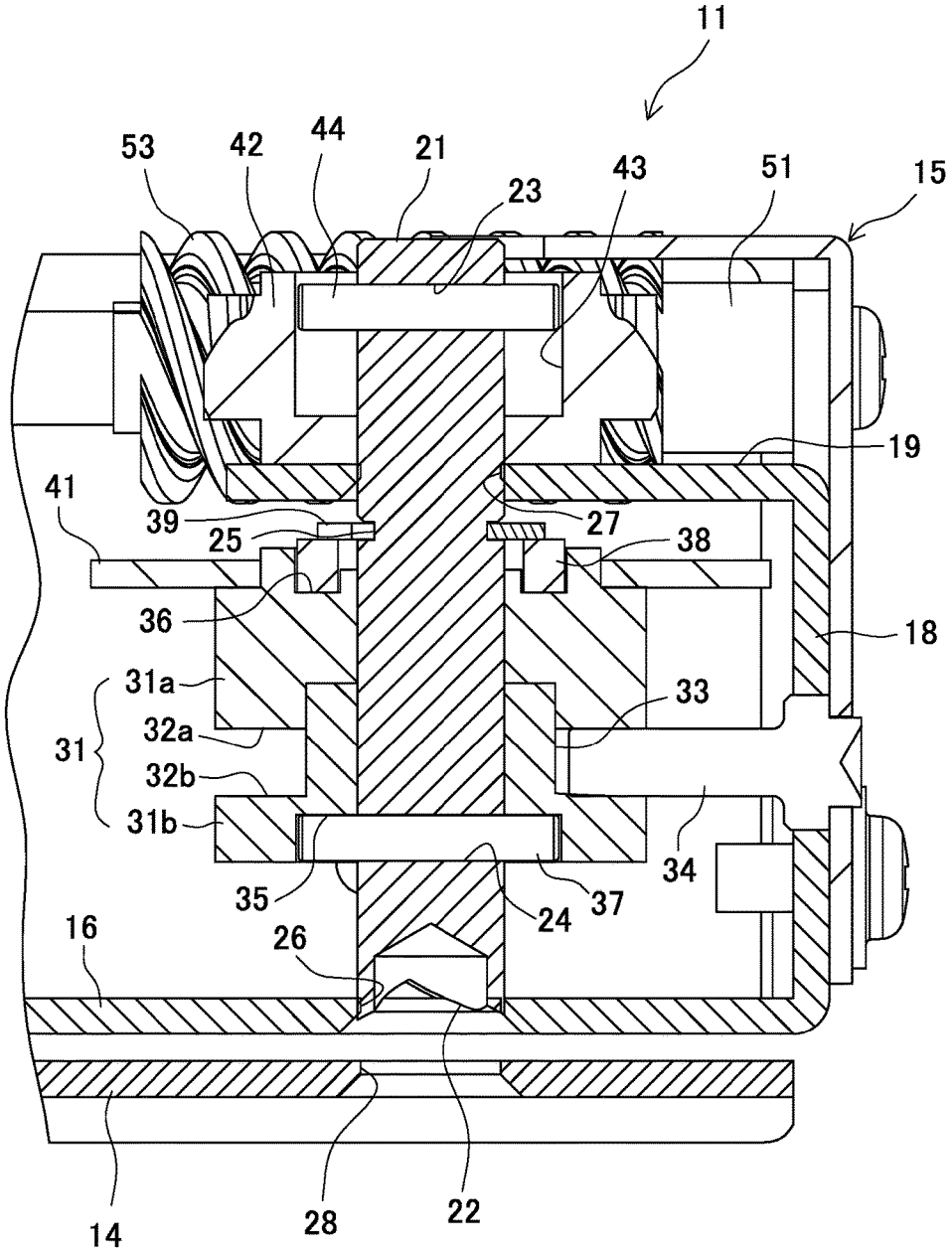
FIG. 7 is a longitudinal section view illustrating the punching component in the punching device.

As shown in FIG. 7, the punching unit 11 has a punching member 21 that extends vertically and has a cylindrical rod shape with a nearly constant diameter over the entire length. The punching member 21 has a tubular punching blade 22 at the bottom end. The tubular part at the bottom end of the punching member 21 is notched in a V shape when seen from the horizontal direction, in such a manner that V-shaped notches are defined in two side parts opposed to each other, and the punching blade 22 is formed along the periphery of the tubular part thus made. The punching member 21 has two through-holes 23 and 24 penetrating the top and bottom parts in the diameter direction and a relatively narrow circumferential groove 25 running around the whole circumference nearly at the center of the axis.

The lower plate 16 and the upper plate 19 in the upper frame 15 have circular through-holes 26 and 27, respectively, that are located at positions corresponding to each other in the vertical direction. An upper end part of the punching member 21 runs through the upper through-hole 27 and a lower end part thereof runs through the lower through-hole 26 in a rotatable and axially slidable manner. In the lower frame 14, a circular die hole 28 that penetrates it to allow the punching blade 22 to punch the sheet S is provided at a position corresponding, in the vertical direction, to the through-hole 26 in the lower plate 16.

The punching member 21 is surrounded concentrically by a cam member 31 that forms a barrel cam. The cam member 31 may comprise an upper cam half 31*a* and a lower cam half 31*b*, each having a nearly cylindrical shape. The upper cam half 31*a* and the lower cam half 31*b* are engaged with each other in such a manner that they can rotate together in the circumferential direction.

The lower face of the upper cam half 31*a* contains an upper cam face 32*a* continuing along the whole circumferential edge. The top face of the lower cam half 31*b* contains a lower cam face 32*b* continuing along the whole circumferential edge. The cam halves 31*a* and 31*b* combined as described above form an endless cam groove 33 running in the circumferential direction in the circumferential face of the cam member 31, as described later.

The side plate 18 has a cam pin 34 that protrudes horizontally toward the circumferential face of the cam member 31. The cam pin 34 is disposed so as to extend into the cam groove 33 to engage with the upper cam face 32*a* and/or the lower cam face 32*b*.

The lower face of the cam member 31 (lower cam half 31*b*) has narrow grooves 35 with a predetermined depth that extend in the diameter direction from the periphery of the shaft hole in which the punching member 21 is fitted. The top face of the cam member 31 (upper cam half 31*a*) has a step 36 with a predetermined width and depth along the periphery of the shaft hole in which the punching member 21 is fitted.

The narrow grooves 35 in the lower face of the cam member 31 are engaged with the end parts of the connecting pin 37 that penetrates the lower through-hole 24 in the punching member 21 and protrudes from both ends of the through-hole. The step 36 in the top face of the cam member 31 is fitted, for example, with a rubber ring 38 and an E-ring 39 is mounted, immediately above it, into the circumferential groove 25 in the punching member 21. This allows the cam member 31 to be integrated with the punching member 21 in the axial and circumferential directions.

In the punching member 21, a sensor flag member 41 designed for position detection by a position sensor that is described later is fixed in an integrated manner to the top face of cam member 31. The sensor flag member 41 is composed mainly of a fan-shaped light-shielding plate that is in the shape of a wing with a certain width extending horizontally outward in the radial direction from the axis of the punching member 21.

The punching member 21 is fitted with a concentric driven gear 42 around the upper end part that protrudes upward through the through-hole 27 in the upper plate 19. The driven gear 42 is a worm wheel, i.e. a helical gear, engaged with a drive worm, i.e. a screw gear, as described later. The top face of the driven gear 42 has a narrow groove 43 with a predetermined depth that extends in the diameter direction from the periphery of the shaft hole in which the punching member 21 is fitted.

The narrow groove 43 in the top face of the driven gear 42 is engaged with the ends of the connecting pin 44 that penetrates through the upper through-hole 23 in the punching member 21 and protrudes from both ends of the through-hole. Both ends of the connecting pin 44 are disposed in the narrow groove 43 so as to be unmovable in the rotation direction of the driven gear 42 and slidable in the axial direction of the driven gear. The driven gear 42 is supported in such a manner that its lower face is in slidable contact with the top face of the upper plate 19. This allows the driven gear 42 to be held in such a manner that it can rotate together with the punching member 21 in the circumferential direction and can move relatively to each other in the axial direction.

As shown in FIGS. 5 and 6, the drive unit 12 includes a drive motor 48 to rotate the punching member 21. The drive motor 48 is attached to the side plate 20 in the horizontal direction in such a manner that the output axis 49 extends horizontally toward the punching unit 11. The output axis 49 is equipped at its one end with a drive gear 50. The drive gear 50 is engaged with an intermediate gear 52 that rotates together with a horizontal rotating rod 51 rotatably supported between the side plate 20 and the side plate 18. The rotating rod 51 has the worm 53 that is engaged with the driven gear 42. This allows the rotation of the drive motor 48 to be transmitted to the punching member 21 so that the punching member is rotated at a decelerated speed.

The drive motor 48 includes an encoder 55 to detect its rotation. The encoder 55 used in the present embodiment is of an optical transmission type and includes a code wheel 56 that is attached to another end of the output axis 49 in such manner that they rotate together and also includes a light projecting unit 57 and a light receiving unit 58 that are disposed opposite to each other with the code wheel interposed therebetween. This allows the rotation of the drive motor 48 to be controlled with high accuracy, for example in relation to the position of the sheet S relative to the punching device 1.

A position sensor 60 to detect the rotational position of the punching member 21 is attached using a mounting stay 61 to the upper frame 15 at a position opposite to the rotating rod 51. The position sensor 60 is a transmissive photosensor with a rectangular box-shaped light projecting unit 62 and light receiving unit 63 that extrude toward the punching member 21. The light projecting unit 62 and the light receiving unit 63 are disposed opposite to each other in the vertical direction with an appropriate gap therebetween so that the sensor flag member 41, which rotates horizontally, can pass through the gap. The position sensor 60 is turned off while light from the light projecting unit 62 reaches the light receiving unit 63 and turned on when the light is blocked by the sensor flag member 41.

The position sensor 60 is not limited to a transmissive photosensor such as described above for the present embodiment. For example, a reflective photosensor, a magnetic sensor, an ultrasonic sensor, or other various generally known sensors may be used as long as they, like the sensor flag member 41, have a detector that rotates together with the punching member 21.

Figure 8:
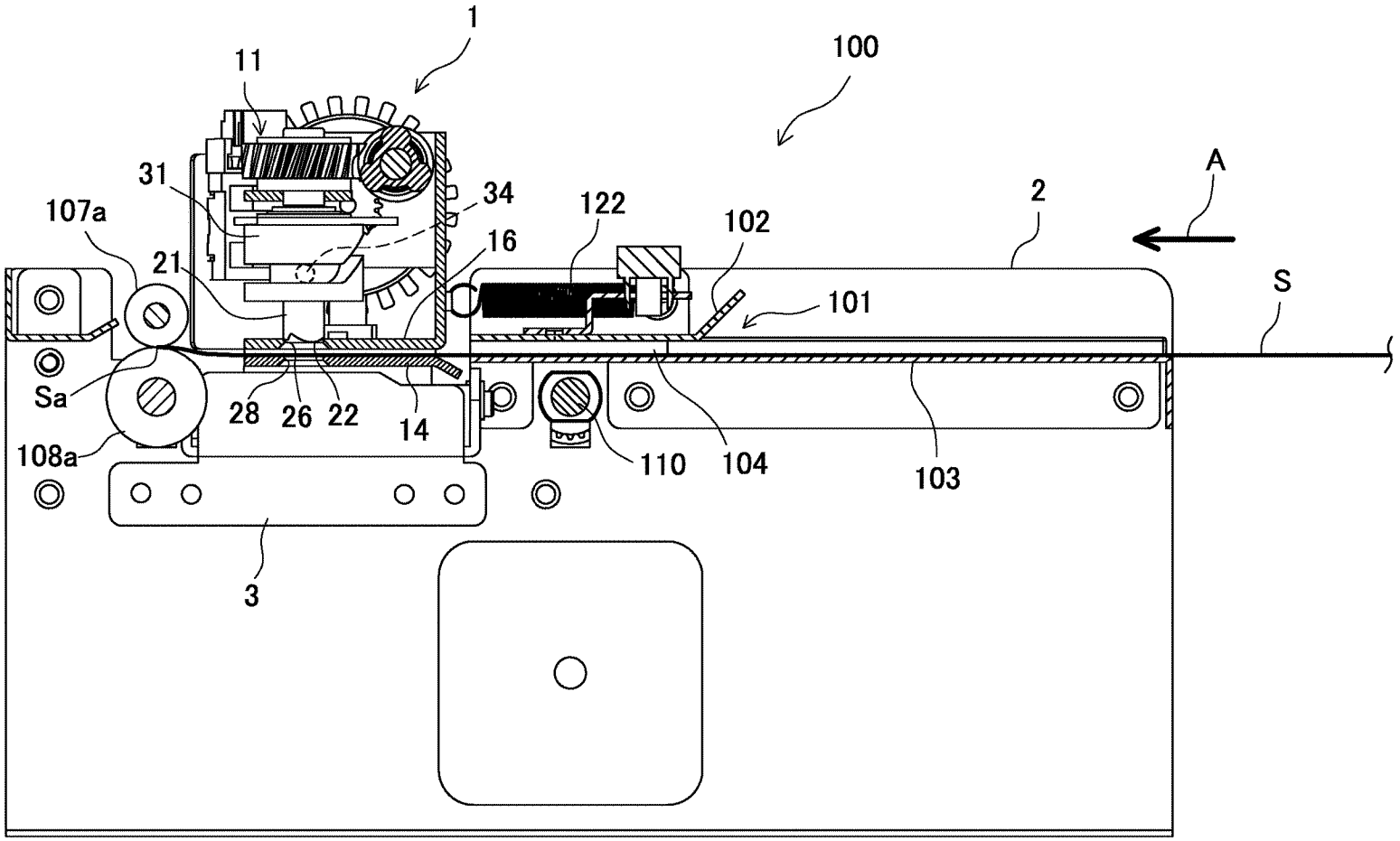
FIG. 8 is a side view of the punching system illustrating the sliding motion of the punching device.

Next, a series of operations of the punching system 100 according to the embodiment to punch the sheet S moving through the guide path 104 at a predetermined conveyance speed is explained below with reference to FIGS. 8 to 11. In FIG. 8, the punching device 1 is in the home position specified above. The punching member 21 is at the top dead point, which is the highest point in the axial direction, and the punching blade 22 is standing by in the through-hole 26 in the lower plate 16. The punching device 1 in this stand-by state starts punching motion when the front end Sa of the sheet S comes to the preset punching start position.

The drive motor 48 is actuated to drive the punching member 21 to rotate clockwise in the top view shown in FIG. 6. The punching member 21 descends in the axial direction, while rotating, from the top dead point according to the profile of the cam groove 33. The punching member 21 descends to the bottom dead point and the punching blade 22 reaches the lowest position in the die hole 28 to produce a punched hole in the sheet S. As the drive motor 48 continues to rotate, the punching member 21 ascends in the axial direction, while rotating, from the bottom dead point. When reaching the top dead point, the punching member 21 comes in the stand-by state to get ready for the next punching motion.

In the present embodiment, the preset punching start position coincides with the pressed contact point between the carry-out rollers 107 and 108, i.e., the point where their circumferential faces are pressed against each other. When the front end Sa of the sheet S comes to the pressed contact point, as shown in FIG. 8, it is detected by a sensor (not shown in the drawings) which cause the punching member 21 to start moving back and forth between the top dead point and the bottom dead point, i.e., the lowest position in the axial direction, to punch the sheet S at a predetermined position.

Figure 9:
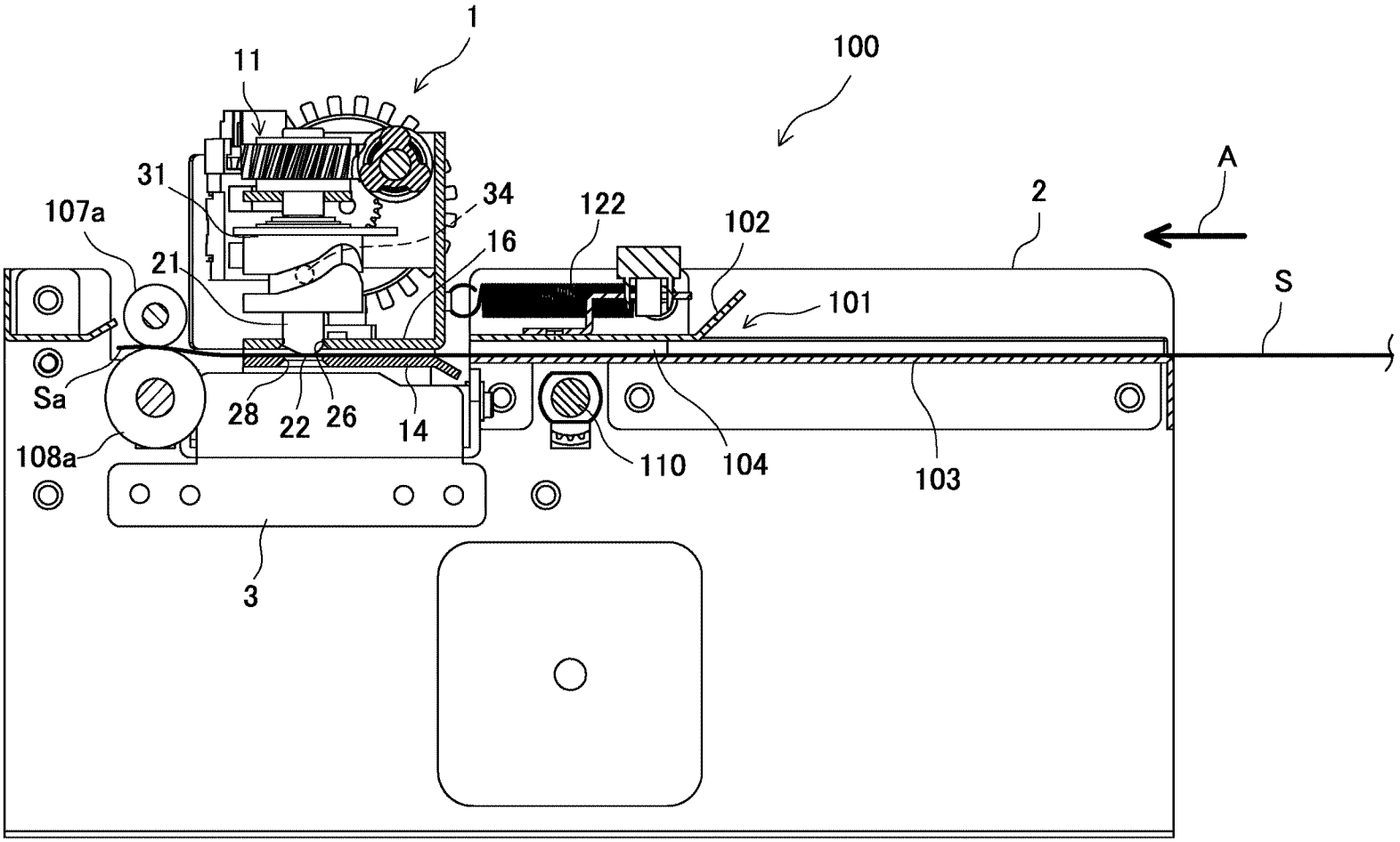
FIG. 9 is a side view of the punching system illustrating the sliding motion of the punching device immediately following the state in FIG. 8.

In FIG. 9, the punching device 1 is still maintained in the home position as the end of the descending punching blade 22 reaches the top face of the sheet S at the predetermined punching position on the sheet S. As the sheet S continues to be conveyed at a predetermined conveyance speed, its front end Sa is moved by the carry-out rollers downstream from the position shown in FIG. 8. The punching of the sheet S actually starts in this state.

After the punching blade 22 starts to punch the sheet S, the periphery of the newly punched hole gets engaged with the circumferential face of the upstream side of the punching member 21 to push the punching member horizontally downstream. Pushed in this way by the engaged periphery of the punched hole in the sheet S, the punching device 1 moves downstream in the sheet conveyance direction against the biasing force of the tension coil spring 122.

Figure 10:
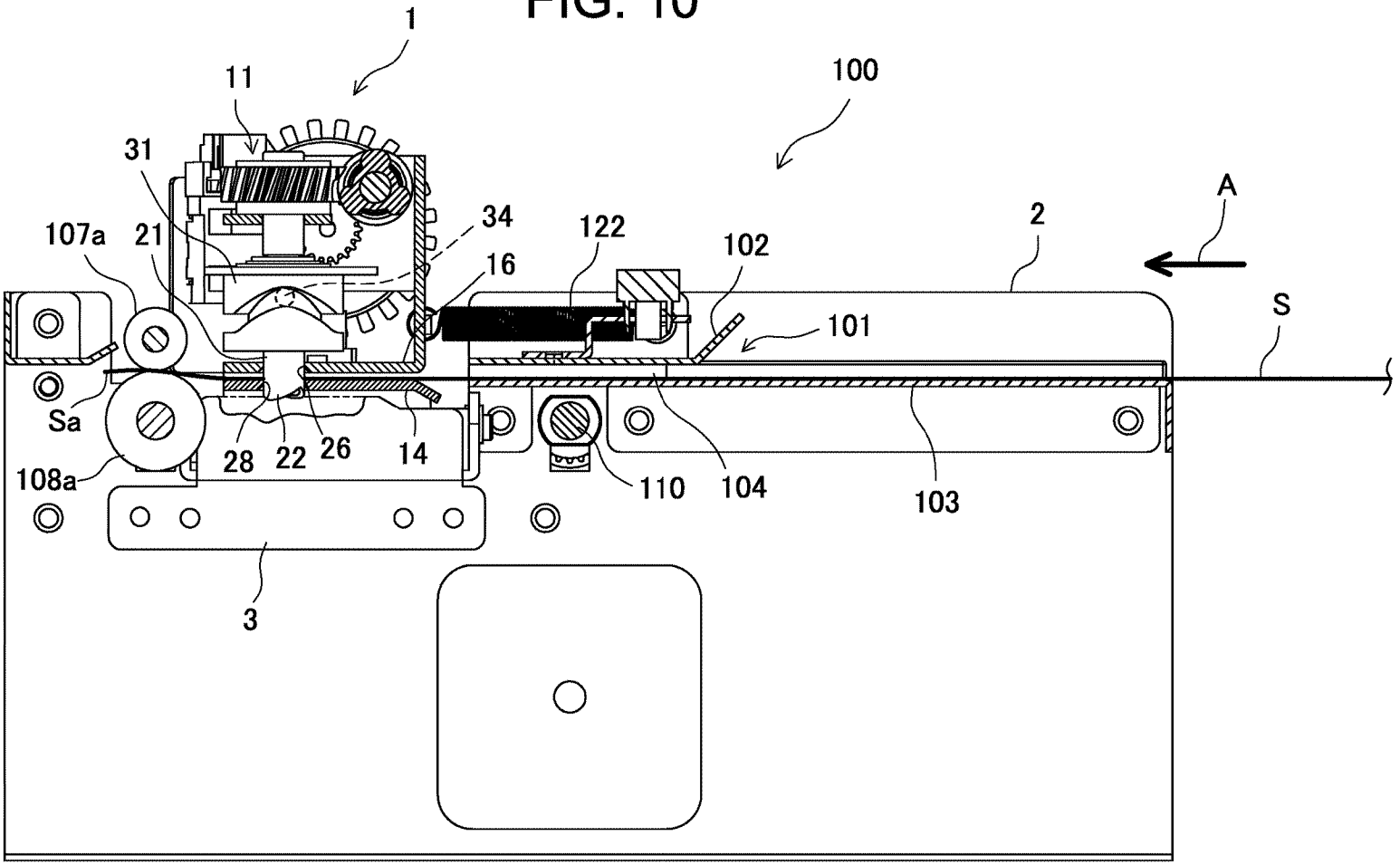
FIG. 10 is a side view of the punching system illustrating the sliding motion of the punching device immediately following the state in FIG. 9.

FIG. 10 shows a state in which the punching member 21 is at the bottom dead point. Subsequently, the punching member 21 withdraws upward from the punched hole and starts to return to the stand-by position in the through-hole 24 in the lower plate 16. During this returning motion, the sheet S continues to be conveyed at the predetermined conveyance speed and accordingly, the punching device 1 further moves downstream in the sheet conveyance direction as long as the periphery of the punched hole is engaged with the circumferential face of the upstream side of the punching member 21.

Figure 11:
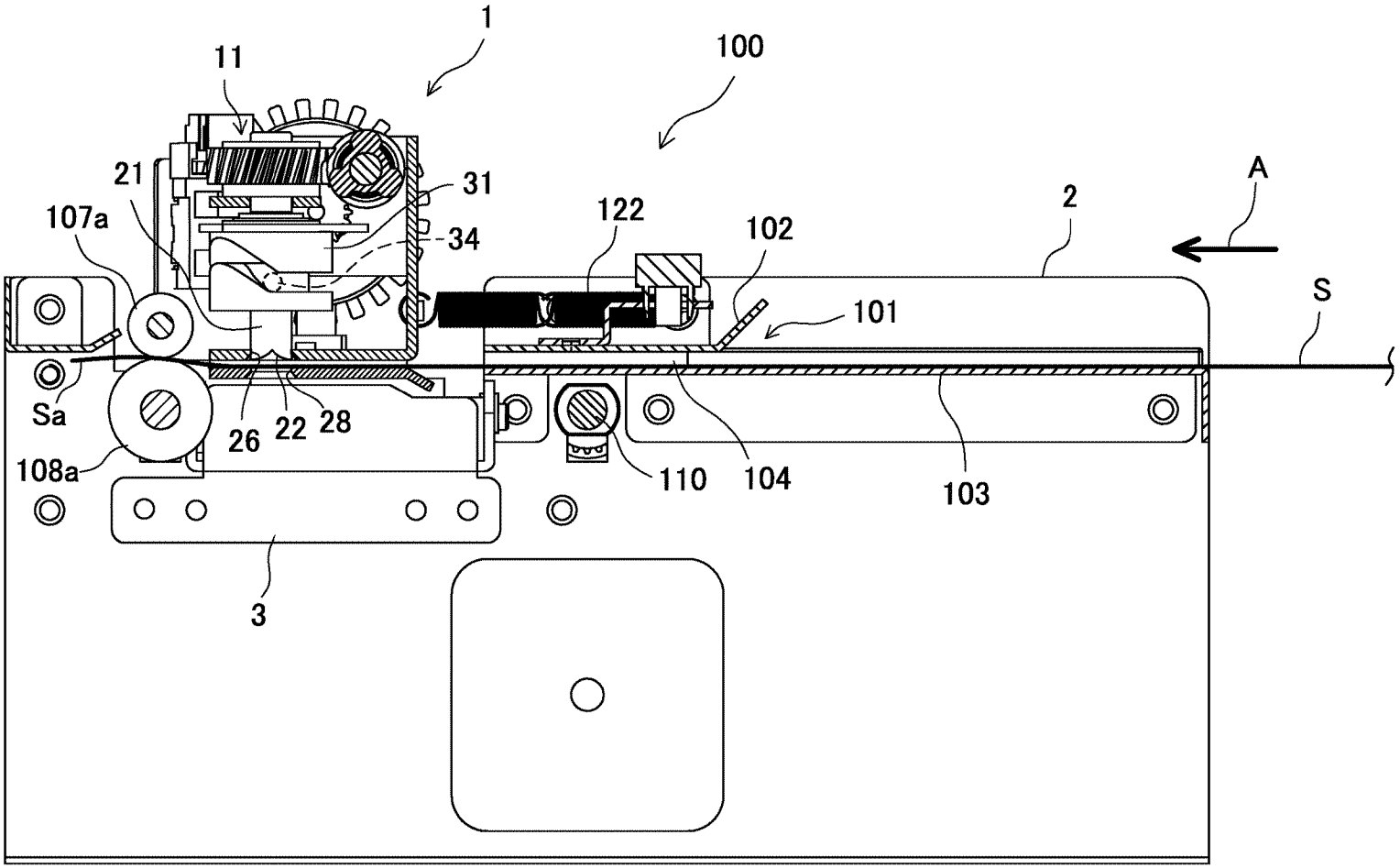
FIG. 11 is a side view of the punching system illustrating the sliding motion of the punching device immediately following the state in FIG. 10.

FIG. 11 shows a state in which the punching member 21 has just withdrawn from the punched hole. At this moment, the punching device 1 is at the farthest position from the home position after moving downstream in the sheet conveyance direction A. After this, the punching device 1 is moved fast horizontally upstream in the sheet conveyance direction by the biasing force of the tension coil spring 122 and returned to the home position where it gets ready for the next punching motion.

While the periphery of the punched hole is engaged with the circumferential face of the upstream side of the punching member 21 during the above punching motion, the carry-in rollers and carry-out rollers working to convey the sheet S encounter a resistance force that is generated in the upstream direction to impede the working of the rollers. This resistance force develops along the edge of the sheet S where the punched hole is produced (farther edge in FIG. 11), which can cause the sheet S to skew.

In the present embodiment, the front end of the sheet is sandwiched between the carry-out rollers 107 and 108 at the start of the punching motion, and the carry-out rollers 107*a* and 108*a*, i.e., the nearest ones to the punching device 1, are disposed on the downstream side of the punching position of the punching member 21 in such a manner that their positions in the transverse direction correspond to the punching member. The carry-out rollers 107*a* and 108*a*, working in combination with the other carry-out rollers 107 and 108, exert a sheet conveying force that can resist the resistance force developing between the punched hole and the punching member 21 so that the front side part of the sheet S is pulled straight in the sheet conveyance direction A, thereby preventing the sheet S from skewing during the punching motion.

Here, the position in the sheet conveyance direction of the punched hole to be produced during the punching motion can be set by adjusting the position of the pressed contact between the carry-out rollers 107 and 108 and the position of the punching member 21. Specifically, it is the farthest possible downstream position in the sheet S where a hole can be punched without skewing the sheet.

The engagement with the circumferential face of the punching member 21 may cause slight turning-up, burrs, etc., around the periphery of the punched hole, possibly leading to quality deterioration of the punched hole. In the present embodiment, the carry-out rollers 107*a* and 108*a* are disposed on the downstream side of the punching position of the punching member 21 in such a manner that their positions in the transverse direction correspond to the punching member, and accordingly, the punched hole inevitably passes between the carry-out rollers 107*a* and 108*a*. Accordingly, turning-up, burrs, etc., around the periphery of the punched hole, if any, will be eliminated as the sheet is pressed in the vertical direction between the rotating carry-out rollers 107*a* and 108*a* to ensure high quality of the punched hole.

In another embodiment, the punching member 21 can start punching motion before the front end of the sheet S to be conveyed is sandwiched between the carry-out rollers 107 and 108, i.e., before it reaches the pressed contact point between the carry-out rollers 107 and 108. In that case, the sheet S passes the punching position of the punching member 21 as it is pushed forward in the sheet conveyance direction A by the carry-in rollers 105 and 106 located on the upstream side. As in the previous embodiment, the punching device 1 moves downstream during the punching motion due to of the engagement of the periphery of the punched hole with the circumferential face of the upstream side of the punching member 21. This allows a hole to be punched at a position whose distance in the sheet conveyance direction from the front end of the sheet is shorter than the distance from the pressed contact point between the carry-out rollers 107 and 108 to the punching position of the punching member 21.

Since in the punching system 100, the punching device 1 produces a punched hole in the sheet S being conveyed and moves together with the sheet S in the sheet conveyance direction A as a result of receiving a force exerted from the periphery of the punched hole to the circumferential face of the punching member 21, the acceleration exerted on the punching device 1 increases with the conveyance speed of the sheet S. This means that a large load is applied suddenly during a very short period to the periphery of the punched hole as the sheet is punched. If too large, this sudden load can cause damage to or quality deterioration of the punched hole, and breakage or cracking of the periphery of the punched hole in the worst case.

In another embodiment, therefore, it is preferable to provide an overload protection mechanism designed to control or reduce such an excessive load exerted between the circumferential face of the punching member 21 and the periphery of the punched hole. Such an overload protection mechanism may be provided on, for example, the carry-out rollers 107 and 108 that are located downstream in the sheet conveyance direction from the punching device 1 to exert a conveying force so as to pull the sheet S.

Specifically, the carry-out roller pair itself can be allowed to have an overload protection function by setting a low pressure for sandwiching the sheet S between the carry-out rollers 107 and 108. In the present embodiment, the sheet sandwiching pressure between the carry-out rollers 107 and 108 can be controlled by adjusting the force of the coil spring 114 pressing the upper carry-out roller 107 against the lower carry-out roller 108, or by slightly decreasing the roller diameter of at least either carry-out rollers 107 or 108 than that of the other carry-out rollers. When an excessive load is applied from the periphery of the punched hole, this allows the sheet S to slip between the carry-out rollers 107 and 108 so as to release part of the load acting near the periphery of the punched hole in the sheet S.

The carry-out rollers 107 and 108 can also be allowed to have an overload protection function by using a roller having a surface with a low friction coefficient as the carry-out roller 108 located on the drive side. This allows the sheet S to slip in a similar way between the carry-out rollers 107 and 108 when an excessive load is applied from the periphery of the punched hole. Accordingly, part of the load acting near the periphery of the punched hole in the sheet S can be released.

An overload protection mechanism as described above can also be provided in the driving force transmission mechanism between the carry-out roller 108 and the drive motor 120. Such overload protection mechanisms include, for example, a torque limiter by which the driving force transmitted from the drive motor 120 to the carry-out roller 108 is limited somewhere therebetween when an excessive load is applied from the periphery of the punched hole in the sheet S to the carry-out roller 108 on the drive side.

Such a torque limiter may be provided, for example, between the carry-out roller shaft 112 and the carry-out roller 108. This torque limiter serves to stop the rotation of the carry-out roller 108 when an excessive load is applied from the periphery of the punched hole in the sheet S to the carry-out roller 108. Such a torque limiter as described above may be provided between the carry-out roller shaft 112 and the pulley 116 or between the carry-in roller shaft 110 and the pulley 115 or the pulley 118.

In the punching blade 22, the tubular periphery at the bottom end of the punching member 21 is notched in a V shape when seen from the horizontal direction, in such a manner that the V-shaped notches are defined in two side parts opposed to each other in the tubular periphery, as described above. In the present embodiment, a straight line Lv connecting the bottoms of the two V-shaped notched grooves, i.e., the bottom vertexes 22*a*, is perpendicular to the sheet conveyance direction A when the punching blade 22 withdraws from the punched hole in the travelling sheet S, as shown in FIGS. 12A and 12B.

Figure 13A:
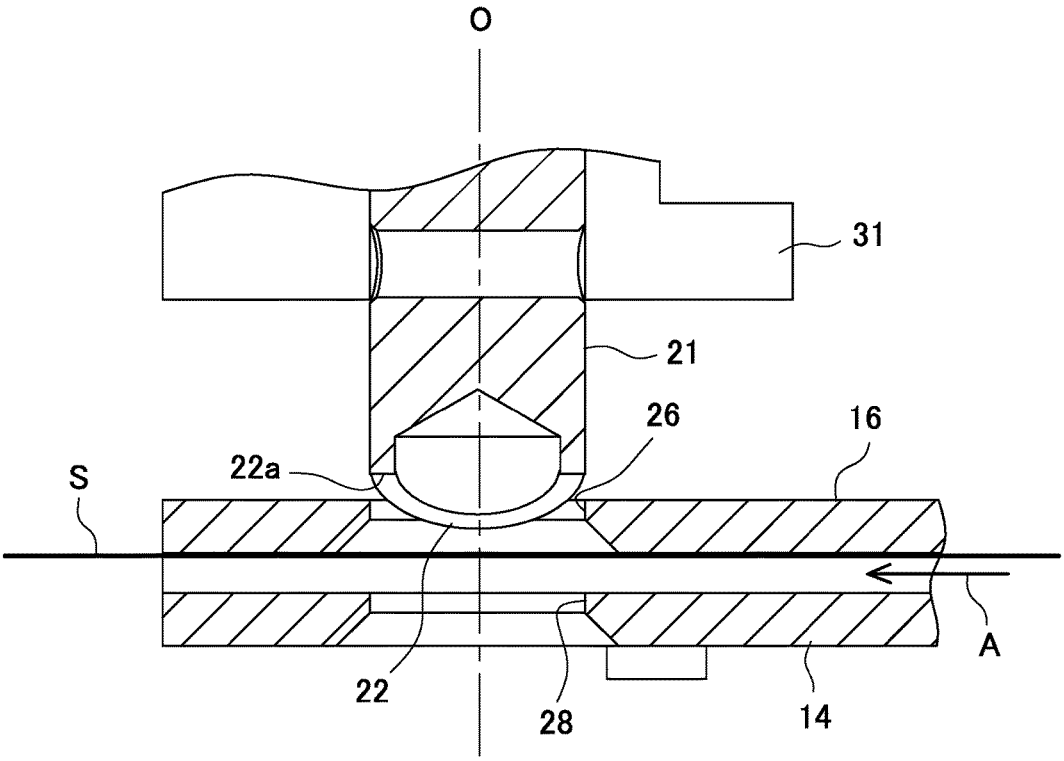
FIGS. 13A and 13B are a cross-sectional view and a bottom view, respectively, similar to FIGS. 12A and 12B illustrating a comparative example of this embodiment.
Figure 13B:
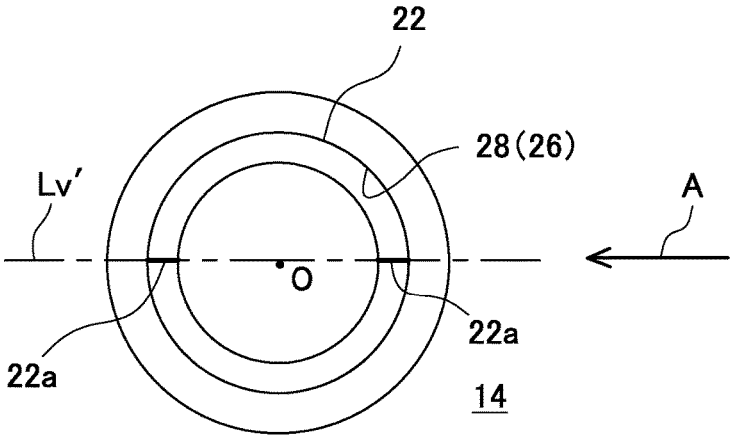

Compared to this, in the system shown in FIGS. 13A and 13B, which gives a comparative example of the present invention, the punching blade 22 is disposed so that a straight line Lv' that connects the bottom vertexes 22*a* of the two V-shaped notches is parallel to the sheet conveyance direction A when it withdraws from the punched hole in the sheet S. In this case, the obliquely inclined blade of the punching blade 22 can cause damage to the periphery of the punched hole as a result of coming in contact with it when withdrawing from the punched hole, possibly leading to quality deterioration of the punched hole.

Figure 12A:
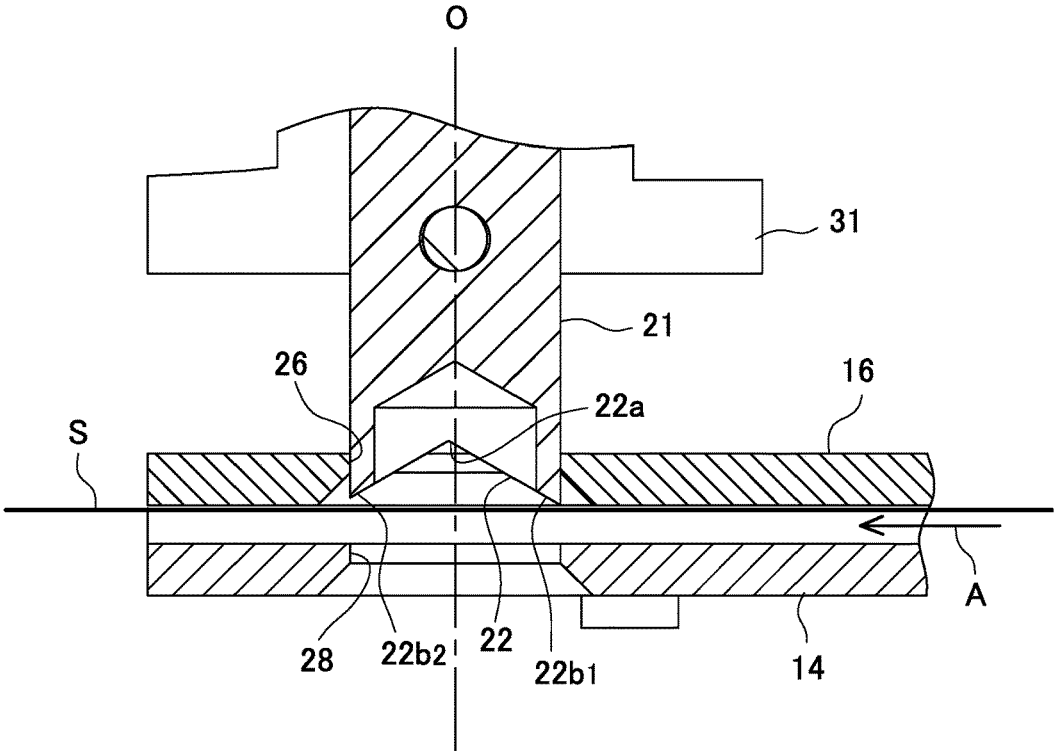
FIG. 12A is a cross-sectional view illustrating the positional relation between the punching blade of the punching member and the sheet to be punched and FIG. 12B is a bottom view illustrating the punching blade of the punching member.
Figure 12B:
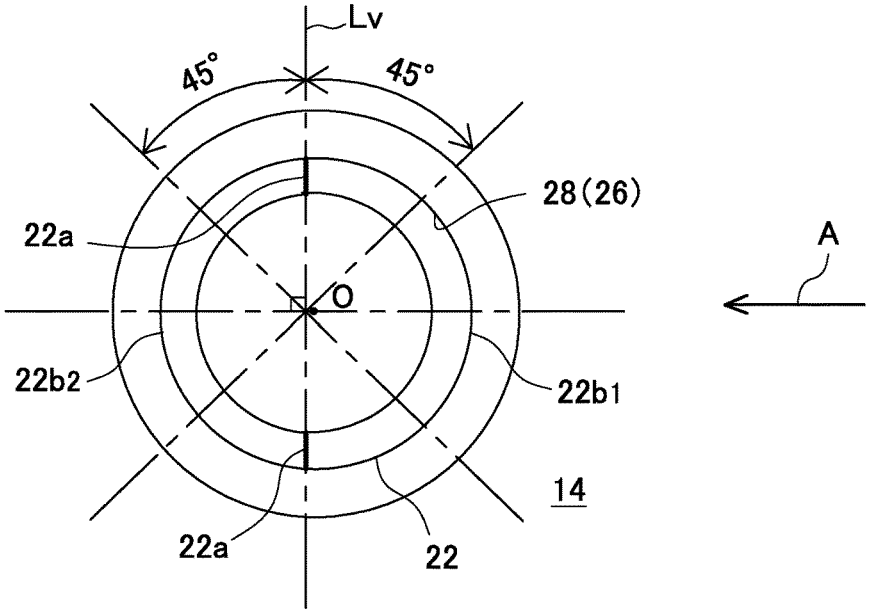

In the present embodiment, a high-quality, high-grade punched hole is produced as a result of initially setting the punching blade 22 in such a manner that its rotational position, i.e., the direction of the straight line Lv, is as shown in FIGS. 12A and 12B when withdrawing from the punched hole in the sheet. This rotational position of the punching blade 22 depends on the position of the cam groove 33 of the cam member 31 that is attached to the punching member 21 and can be adjusted by changing the attaching position of the cam member 31 relative to the punching member.

Here, it is not necessary for the straight line Lv connecting the bottom vertexes 22*a* of the two V-shaped notches, which represents the rotational position of the punching blade 22, to be accurately perpendicular to the sheet conveyance direction A when the blade withdraws from the punched hole in the sheet S. The straight line Lv connecting the bottom vertexes 22*a* of the two V-shaped notches preferably forms an angle in the range of 90°±45° with the sheet conveyance direction A when the punching member 21 withdraws from the punched hole in the sheet S, as shown in FIG. 12B. Thus, the aforementioned damage to the punched hole can be eliminated or reduced more thoroughly by disposing the punching blade 22 in this way.

It is not necessary either for the bottom vertexes 22*a* of the two V-shaped notches in the punching blade 22 to be disposed in point symmetry with respect to the axis of the punching member 21. In the present embodiment, the vertexes 22*a*, and accordingly the straight line Lv connecting them, are located slightly downstream in the sheet conveyance direction A from the axis O of the punching member 21, as shown in FIGS. 12A and 12B.

The punching blade 22 has pointed ends 22*b*1 and 22*b*2 between the two bottom vertexes 22*a* of the V-shaped notches on the tubular periphery. Since the two V-shaped notches are not located in point symmetry, either of the pointed ends is located higher in the axial direction of the punching member 21 than the other. In the present embodiment, in which the two bottom vertexes 22*a* are disposed as described above, the pointed end 22*b*1, which is located on the upstream side, is located slightly higher than the pointed end 22*b*2, which is located on the downstream side.

As a result, when the punching member 21 withdraws from the punched hole in the sheet S, the downstream-side pointed end 22*b*2 of the punching blade 22 is released upward from the punched hole slightly earlier than the upstream-side pointed end 22*b*1 while the upstream-side pointed end is still engaged with the upstream-side periphery of the punched hole. This can prevent the periphery of the punched hole in the sheet S moving in the sheet conveyance direction A from being damaged as a result of coming in contact with the downstream-side pointed end 22*b*2 or neighboring parts of the punching blade 22 on either side thereof along the circumference.

FIGS. 14 to 16B show another embodiment of the punching device used in the punching system 100 according to the present invention. As in the case of the punching device 1 according to the above embodiment, the punching device 130 according to this embodiment can be mounted to the frame 2 of the punching system 100 using an attachment unit 3. A tension coil spring is provided between the punching device 130 and a pin (not shown in the drawings) protruding from the frame 2 so that the punching device is normally biased by the force of the spring toward its home position located upstream in the sheet conveyance direction A.

The punching device 130 has a punching unit 131, a drive unit 132, and a frame structure 133. The frame structure 133 has a lower plate 134 and an upper plate 135, each being in the form of a roughly rectangular, flat plate. The lower and upper plates are disposed opposite to each other with a constant narrow gap therebetween to define a guide path that guides the sheet to be punched in the sheet conveyance direction A and they are combined together at one side (the left hand side in FIG. 14) with a spacer plate 136 sandwiched therebetween. The punching unit 131 is attached to the upper plate 135.

The frame structure 133 further includes a side plate 137 and a side plate 138. The side plate 137 is bent nearly perpendicularly at an end of the lower plate 134 where the spacer plate 136 is located, and extends upward in the vertical direction. The side plate 138 is bent nearly perpendicularly from the upper plate 135 at a farther end from the spacer plate 136, and extends upward in the vertical direction so as to be opposed to the side plate 137. The drive unit 132 is located between the side plates 137 and 138.

Figure 14:
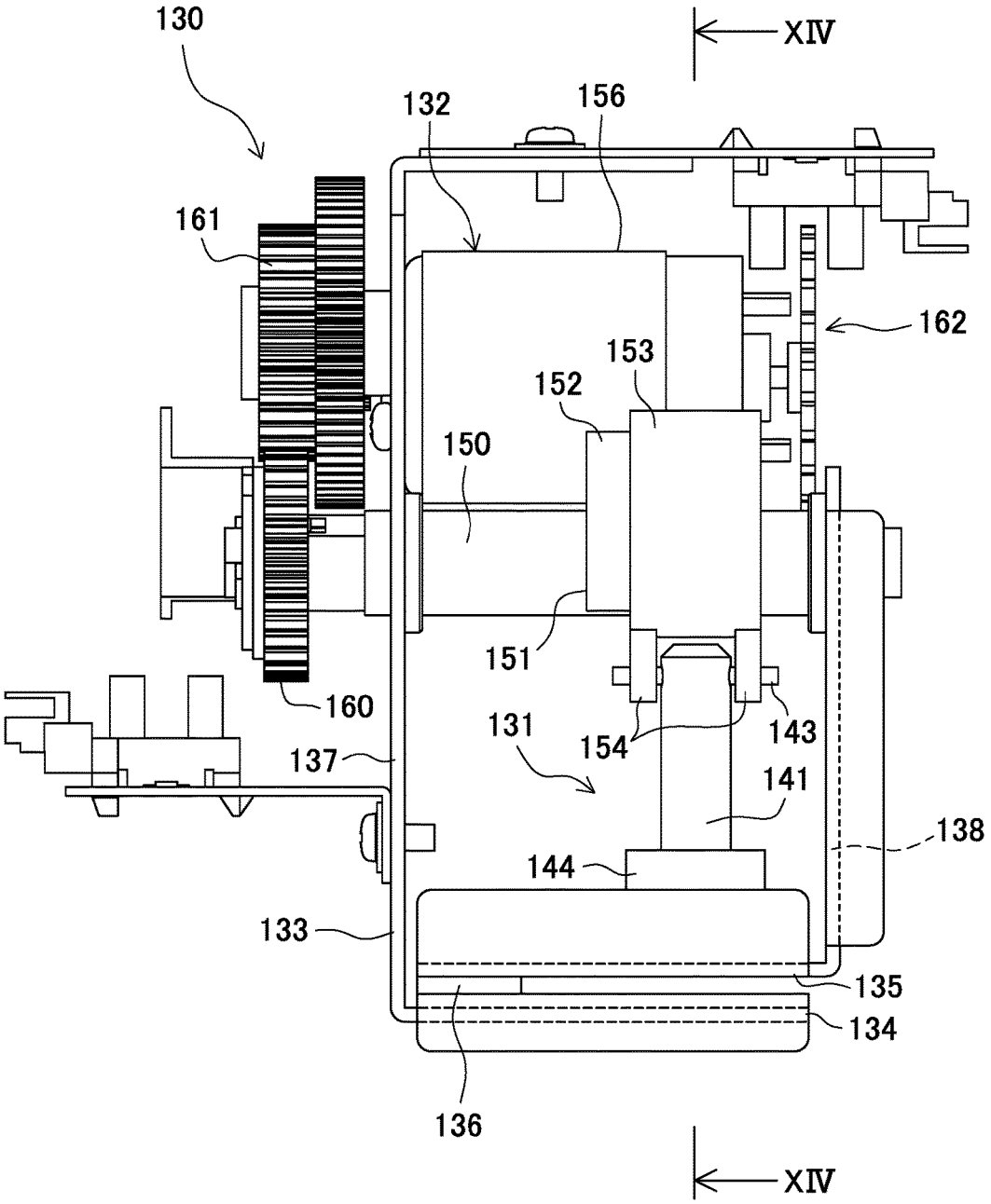
FIG. 14 is a front view illustrating another embodiment of the punching device.
Figure 15:
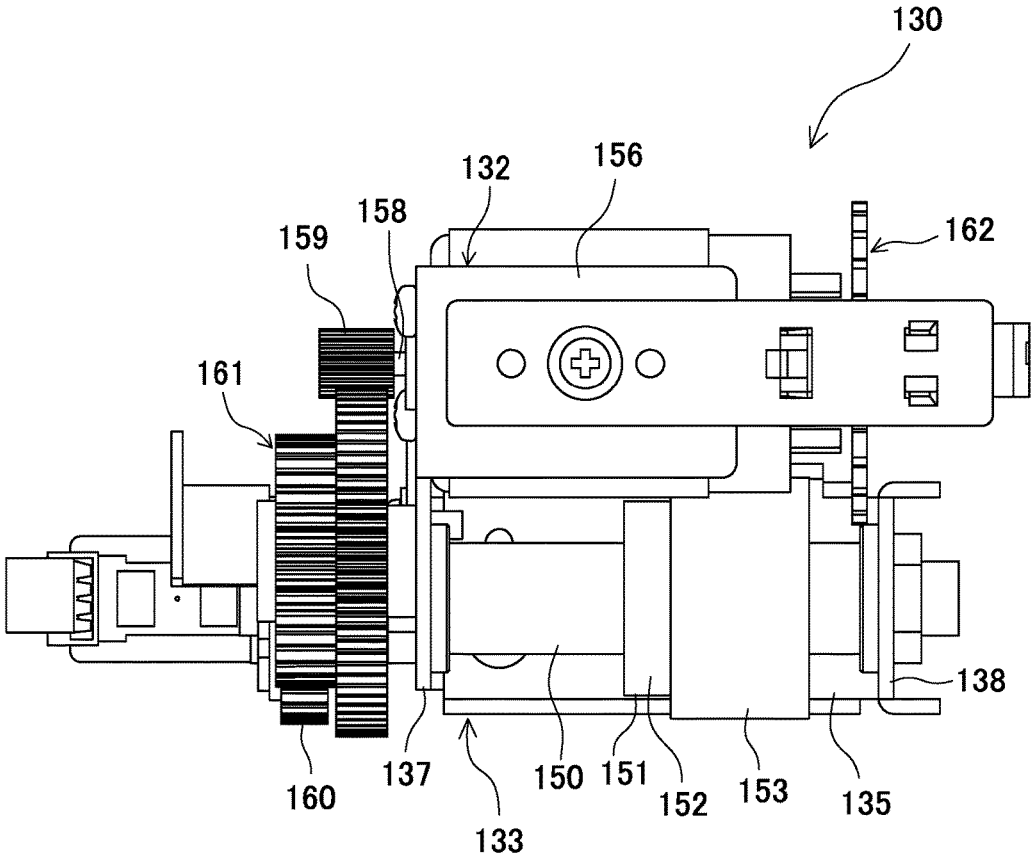
FIG. 15 is a top view of the punching device illustrated in FIG. 14.
Figure 16A:
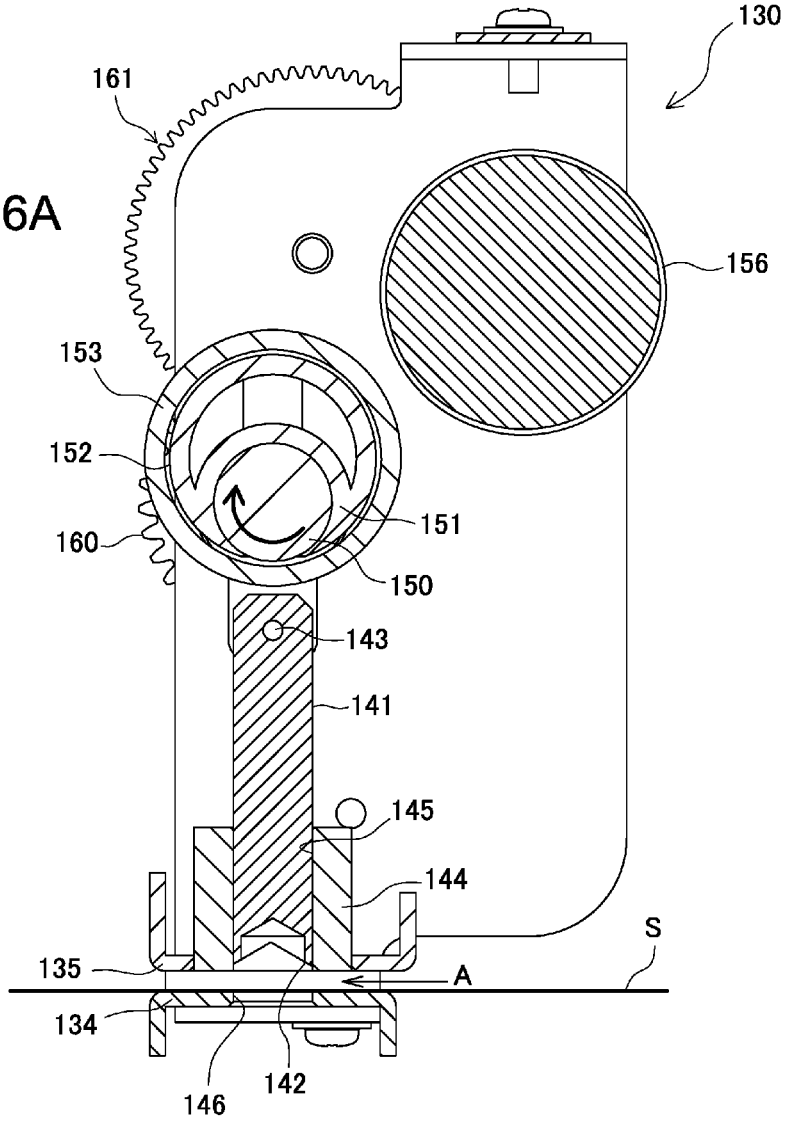
FIG. 16A is a XIV-XIV cross-sectional view of the punching device illustrated in FIG. 14
Figure 16B:
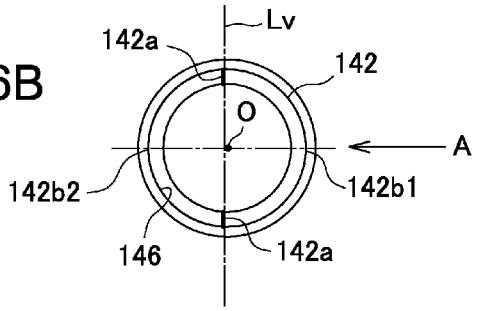
FIG. 16B is a bottom view of the punching member.

As shown in FIGS. 16A and 16B, the punching unit 131 has a punching member 141 that extends vertically and has a cylindrical rod shape with a nearly constant diameter over the entire length. Similarly to the punching member 21, the punching member 141 has a tubular punching blade 142 at a bottom end thereof. In the punching blade 142, the tubular periphery of the punching member 141 is notched in a V shape when seen from the horizontal direction, in such a manner that the V-shaped notches are defined in two side parts opposed to each other in the tubular periphery. As shown in FIG. 14, a connecting pin 143 penetrates the upper end part of the punching member 141 in the perpendicular direction to the axis of the punching member.

On the upper plate 135, a cylindrical guide block 144 for the punching member 141 is attached integrally so as to protrude perpendicularly upward from the upper plate. The guide block 144 has a circular guide hole 145 penetrating it in the vertical direction, and the punching member 141 is installed in such manner that it can reciprocate through the guide hole in the axial direction. In the lower plate 134, a circular die hole 146 that penetrates it to allow the punching blade 142 to punch the sheet S is provided at a position opposite to the lower opening of the guide hole 145.

The drive unit 132 has a drive rod 150 for driving the punching member 141 and supported between the side plates 137 and 138 so as to be rotatable horizontally. The drive rod 150 has a circular eccentric cam 151 that is mounted on a circumference thereof so as to rotate integrally therewith. The circular eccentric cam 151 has a barrel cam follower member 153 that is mounted thereon in such a manner that its internal circumference is in slidable contact with the cam face 152, i.e., the circumferential face of the cam.

For supporting the punching member 141, a pair of horizontally separated attachment supports 154 is attached to the circumferential face of the cam follower member 153 to protrude therefrom. The punching member 141 has its upper end disposed between the attachment supports 154 and constantly held vertically by a connecting pin 143 that protrudes from the punching member outward in the radius direction and has its two ends inserted through the attachment supports 154 to support it rotatably.

The drive unit 132 further includes a drive motor 156 that is attached horizontally to the side plate 137 and positioned parallel to the drive rod 150. The output shaft 158 of the drive motor 156 protrudes outward through the side plate 137 and has a drive gear 159 mounted on a protruding end thereof. Meanwhile, the drive rod 150 protrudes outward through the side plate 137 and has a driven gear 160 mounted on a protruding end thereof. An intermediate gear train 161 is provided between the drive gear 159 and the driven gear 160 and interengaged with them in such a manner that the rotational motion of the drive motor 156 is transmitted to the punching member 141 to rotate the punching member at a reduced speed.

The drive motor 156 is equipped with an encoder 162 to detect its rotation and control it with high accuracy. As in the embodiment shown in FIG. 3, the encoder 162 in the present embodiment is of an optical transmission type, but magnetic type encoders and various other generally known sensors may also be used.

As illustrated in FIGS. 8 to 11 in relation to the embodiment shown in FIG. 1, the punching device 130 standing by in the predetermined home position starts punching motion when the front end of the sheet S reaches the preset punching start position. The drive motor 156 is actuated to start the drive rod 150 rotating clockwise as indicated by an arrow in FIG. 16A and accordingly, the punching member 141 moves down in the axial direction from the top dead point shown in FIG. 16A according to the profile of the circular eccentric cam 151. The punching member 21 moves down to the bottom dead point where the punching blade 142 reaches the lowest position in the die hole 146 to produce a punched hole in the sheet S. As the drive motor 156 continues to rotate, the punching member 141 moves up in the axial direction from the bottom dead point to the top dead point and returns to the stand-by state where it is ready for the next punching motion.

As shown in FIG. 16B, the punching blade 142 of the punching member 141 is disposed in such a manner that a straight line Lv connecting the bottoms of the two V-shaped notched grooves, i.e., the bottom vertexes 142*a*, is perpendicular to the sheet conveyance direction A. This always allows a high-quality, high-grade punched hole to be produced in the sheet as in the case of the punching device 1 shown in FIG. 3. In the present embodiment as well, the straight line Lv connecting the bottom vertexes 142*a* of the V-shaped notches in the punching blade 142 is not necessarily perpendicular to the sheet conveyance direction A, but it only needs to form an angle in the range of 90°±45° with the sheet conveyance direction A. This surely serves to eliminate or decrease the possibility that the punched hole produced in the travelling sheet may suffer from damage or quality deterioration caused by the punching blade 142 itself.

In the present embodiment as well, it is not necessary for the bottom vertexes 142*a* of the two V-shaped notches in the punching blade 142 to be disposed in point symmetry with respect to the axis of the punching member 141. Since the punching blade 142 is disposed in such a manner that the straight line Lv connecting the bottom vertexes 142*a* of the two V-shaped notches runs through the area located slightly downstream in the sheet conveyance direction A from the axis O of the punching member 141, the upstream-side pointed end 142*b*1 is located slightly higher than the downstream-side pointed end 142*b*2. Accordingly, when the punching member 141 withdraws from the punched hole in the sheet S, the downstream-side pointed end **142*b*2 of the punching blade 142 is released upward from the punched hole slightly earlier than the upstream-side pointed end 142*b*1, thus eliminating the possibility that the periphery of the punched hole may be damaged by the downstream-side pointed end 142*b*2 or neighboring parts of the punching blade 142** on either side thereof along the circumference.

Although the present invention has been described above with reference to the preferred embodiments thereof, it is understood that the invention is not limited to these embodiments and various modifications or changes may be made without departing from the scope of the invention. For example, various other punching devices having different structures from the above embodiments may be applied as long as they have a punching member that punches a hole as it moves back and forth in the perpendicular direction to the sheet being conveyed horizontally. Furthermore, the punching system according to the present invention can be applied not only to image formation and post-processing apparatuses, but also to any other sheet or paper processing apparatuses having a function of punching a hole in a sheet being conveyed.

The invention claimed is:

1. A punching system comprising:

a sheet conveyance mechanism conveying a sheet in a predetermined conveyance direction, a punching device having a punching member with a punching blade at one axial end thereof and moving the punching member reciprocally in an axial direction perpendicular to the sheet to produce a punched hole in the sheet conveyed in the predetermined conveyance direction through the sheet conveyance mechanism, and a support portion including a fixed support member, and a movable attachment member to which the punching device is fixed, wherein while the sheet conveyance mechanism conveys the sheet, the punching member produces the punched hole in the sheet, so that the punching member engages a periphery of the punched hole and the conveyance mechanism moves the punching device together with the sheet in the predetermined conveyance direction.

2. A punching system as set forth in claim 1, further comprising a spring biasing the punching device in an opposite direction to the predetermined conveyance direction.

3. A punching system as set forth in claim 2, wherein the movable attachment member is movable relative to the support member along the predetermined conveyance direction from a home position of the punching device toward a downstream side, and the spring is constantly biasing the punching device along the predetermined conveyance direction from the downstream side toward the home position.

4. A punching system as set forth in claim 1, wherein the punching blade is formed on a periphery of a cylindrical part at the one axial end of the punching member, the periphery of the cylindrical part having two V-shaped notches located at two positions opposed to each other when seen from a lateral direction, and the two V-shaped notches being arranged such that a straight line connecting two bottom vertexes of the two V-shaped notches is perpendicular to the predetermined conveyance direction when the punching blade moving along the axial direction withdraws from the punched hole in the sheet.

5. A punching system as set forth in claim 4, wherein the punching blade includes two pointed ends at the periphery of the cylindrical part along a circumferential direction, each of the two pointed ends being formed between the two bottom vertexes of the two V-shaped notches, the two pointed ends including a first pointed end and a second pointed end positioned higher than the first pointed end in the axial direction, and the punching member is configured so that when the punching member moving along the axial direction withdraws from the punched hole in the sheet, the second pointed end is positioned on an upstream side of the predetermined conveyance direction relative to the first pointed end.

6. A punching system as set forth in claim 5, wherein when the punching member moving along the axial direction withdraws from the punched hole in the sheet, the straight line connecting the two bottom vertexes of the two V-shaped notches is positioned on a downstream side of the predetermined conveyance direction relative to an axis of the punching member.

7. A punching system as set forth in claim 4, wherein the punching member produces the punched hole in the sheet by rotating about an axis of the punching member and moving reciprocally along the axial direction.

8. A punching system as set forth in claim 1, wherein the sheet conveyance mechanism includes a sheet conveyance portion at a position downstream in the predetermined conveyance direction from a punching position where the sheet is punched by the punching member and corresponding to the punching position in a direction perpendicular to the predetermined conveyance direction, to feed the sheet forward in the predetermined conveyance direction at a start of punching of the sheet.

9. A punching system as set forth in claim 8, wherein the sheet conveyance portion comprises a pair of rollers adapted to sandwich the sheet in a vertical direction of the sheet.

10. A punching system as set forth in claim 9, further comprising an overload protection mechanism adapted to reduce a load acting in the predetermined conveyance direction between the circumferential face of the punching member and the periphery of the punched hole that are engaged with each other as the punching device and the sheet move in the predetermined conveyance direction.

11. A punching system as set forth in claim 10, wherein the overload protection mechanism is provided to the pair of rollers.

12. A punching system as set forth in claim 1, wherein the punching device further includes a flat sheet support face integral with the punching device and fixed to the movable attachment member, for guiding the sheet conveyed in the predetermined conveyance direction, and a die hole provided on the sheet support face, for the punching blade of the punching member moving reciprocally along the axial direction to produce the punched hole in the sheet guided on the sheet support face.

13. A punching system as set forth in claim 12, wherein the punching member is supported by the punching device so that the axial direction is perpendicular to a face of the sheet guided on the sheet support face.

14. A punching system as set forth in claim 1, further comprising:

a frame to which the supporting member is fixed, and a spring arranged between the punching device and the frame, and biasing the punching device in an opposite direction to the predetermined conveyance direction, wherein the movable attachment member is slidably arranged on the support member, the sheet conveyance mechanism includes a pair of rollers arranged at a downstream side of the punching device to convey the sheet in the predetermined conveyance direction, and when the circumferential face of the punching member and the periphery of the punched hole are engaged with each other, the punching member slides on the support member in the predetermined conveyance direction with the sheet on which the punching member produces the punched hole, and when the circumferential face of the punching member and the periphery of the punched hole are disengaged from each other, the punching member slides on the support member in a direction opposite to the predetermined conveyance direction with a biasing force of the spring.

15. An image forming apparatus comprising the punching system as set forth in claim 1.

16. A sheet processing apparatus comprising the punching system as set forth in claim 1.

17. An image forming apparatus comprising the sheet processing apparatus as set forth in claim 16.

* * * * *